United States Patent [19]

Morettin et al.

[11] Patent Number: 4,628,651

[45] Date of Patent: Dec. 16, 1986

[54] FIRE-RETARDANT WALL

[75] Inventors: Mario P. Morettin, Williamsville; Richard A. Costolnick, Kenmore, both of N.Y.

[73] Assignee: National Gypsum Company, Dallas, Tex.

[21] Appl. No.: 761,618

[22] Filed: Aug. 1, 1985

[51] Int. Cl.[4] ..... E04B 1/00

[52] U.S. Cl. ..... 52/283; 52/317; 52/481

[58] Field of Search ..... 52/238.1, 317, 481, 52/772, 775, 780, 781, 270, 281, 282, 285, 286

[56] References Cited

FOREIGN PATENT DOCUMENTS

| | | | |
|---|---|---|---|
| 171635 | 6/1916 | Canada | 52/481 |
| 816627 | 8/1937 | France | 52/481 |
| 1277982 | 10/1961 | France | 52/479 |
| 1532095 | 11/1978 | United Kingdom | 52/481 |

*Primary Examiner*—Henry E. Raduazo
*Assistant Examiner*—Dan W. Pedersen
*Attorney, Agent, or Firm*—Robert F. Hause

[57] ABSTRACT

A hollow wall having a plurality of spaced, vertical studs, wallboards affixed to both sides of the plurality of studs, and septum panels disposed within the hollow of the wall, held firmly in place by small pieces of board, with one such piece of board on each side of the septum panels, at each side edge, extending through an opening in a stud.

3 Claims, 3 Drawing Figures

FIRE-RETARDANT WALL

This invention relates to a novel fire-retardant drywall on metal stud structure, and particularly to a novel means for stabilizing a gypsum septum board within a hollow wall.

BACKGROUND OF THE INVENTION

Hollow walls with ½ inch gypsum wallboard on each face have been made more fire-retardant or more sound-proof by the inclusion within the hollow space between adjacent studs of an additional piece of gypsum wallboard, referred to as a septum panel. This additional piece of wallboard or septum panel was not affixed to anything, but, instead, simply lay slightly diagonally against one of the wallboards forming one of the wall faces.

Determination of the fire-retardant characteristics of a wall involves a fire test in which the wall is subjected, first, to the heat of a fire against one face of the wall, in special fire testing furnaces. Almost immediately after being removed from this furnace the heated face of the wall is subjected to a hose stream test in which a stream of water, under considerable pressure, is maintained, impinging on the heated face. In testing a hollow wall with a loosely disposed septum panel inside, it was noted that the loosely disposed septum panel was moving back and forth as the hose stream was moved first crosswise over various parts of the wall, then vertically over various parts of the wall, then crosswise, etc. It was further noted that this movement of the septum panel was contributing to the tendency of the wall to fail the hose stream test, by causing some part of the wall to open up and permit water to pass through the wall and project out from the remote side.

SUMMARY OF THE INVENTION

In the present invention, the ½ inch thick septum panels in a hollow wall are stabilized by the placing of two small scraps of ½ inch board in a standard 1½ inch opening in the web of a drywall metal stud, one on each side of the septum panel, thus holding the septum panel firmly, centered within the hollow of the wall, between the two opposed face boards.

It is a primary object of the invention to provide a wall of improved fire-retardant characteristics.

It is a further object to provide improved fire-retardant properties in a wall by the stabilization of a septum panel therewithin.

It is a still further object to provide stabilization of a septum panel by a novel, easy to build and inexpensive structure.

BRIEF DESCRIPTION OF THE DRAWINGS

These and other objects and advantages of the invention will be more readily apparent when considered in relation to the preferred embodiment, as set forth in the specification, and shown in the drawings, in which.

DESCRIPTION OF THE PREFERRED EMBODIMENT

Figure 1:
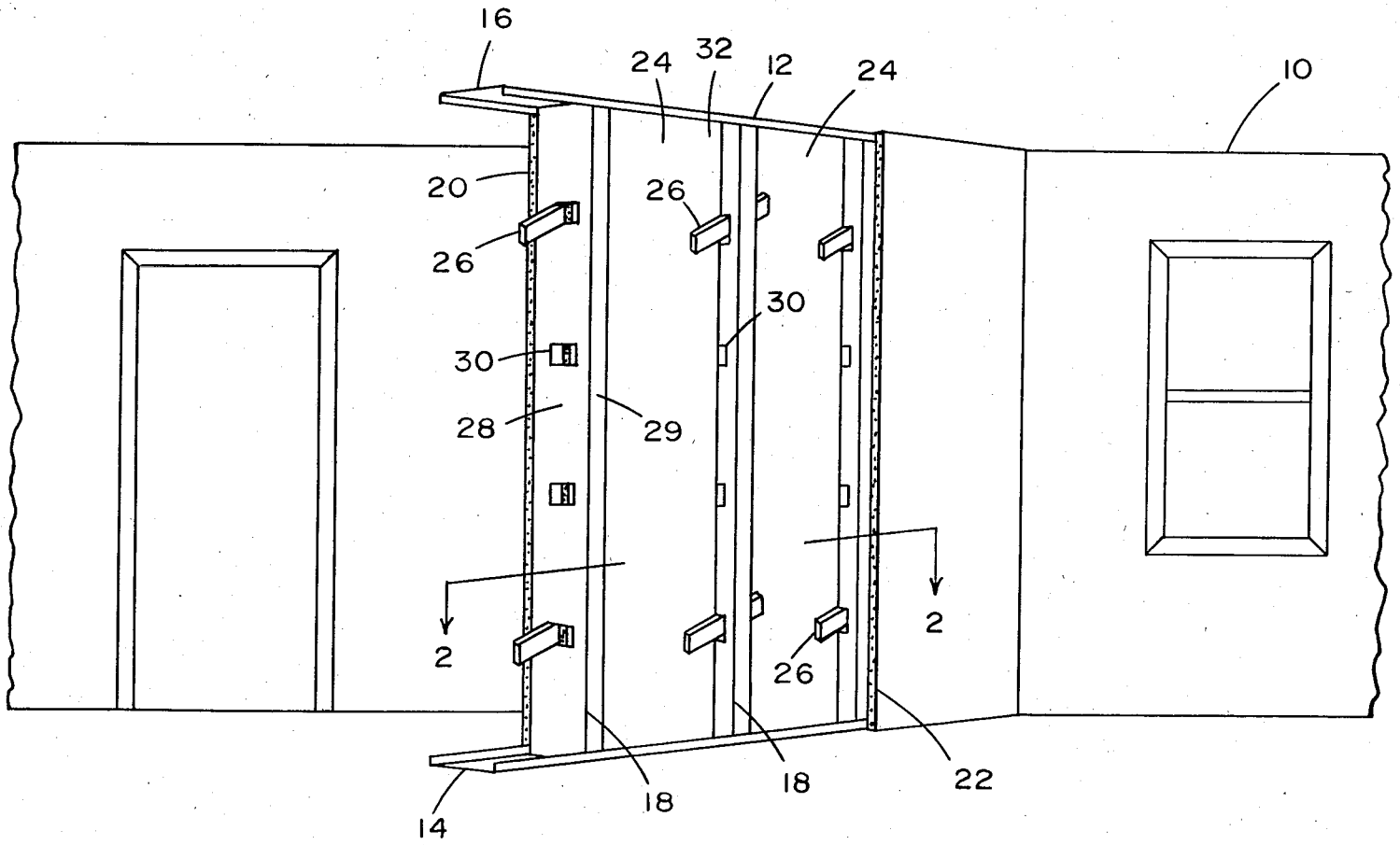
FIG. 1 is a perspective view of an incomplete building partition incorporating septum panels stabilized in accordance with the present invention.
Figure 2:
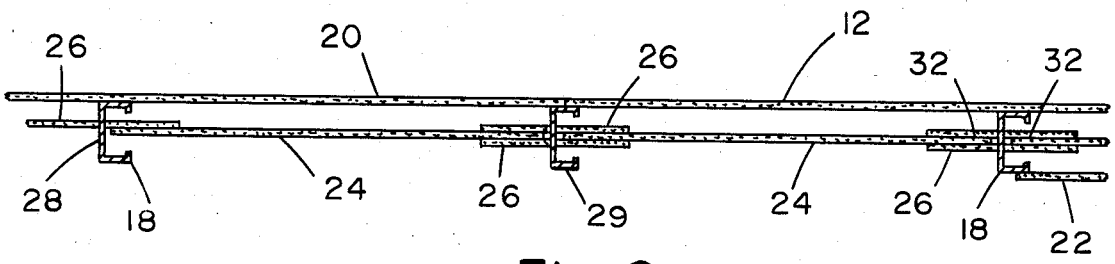
FIG. 2 is a sectional view of the partition of FIG. 1, taken on line 2—2.
Figure 3:
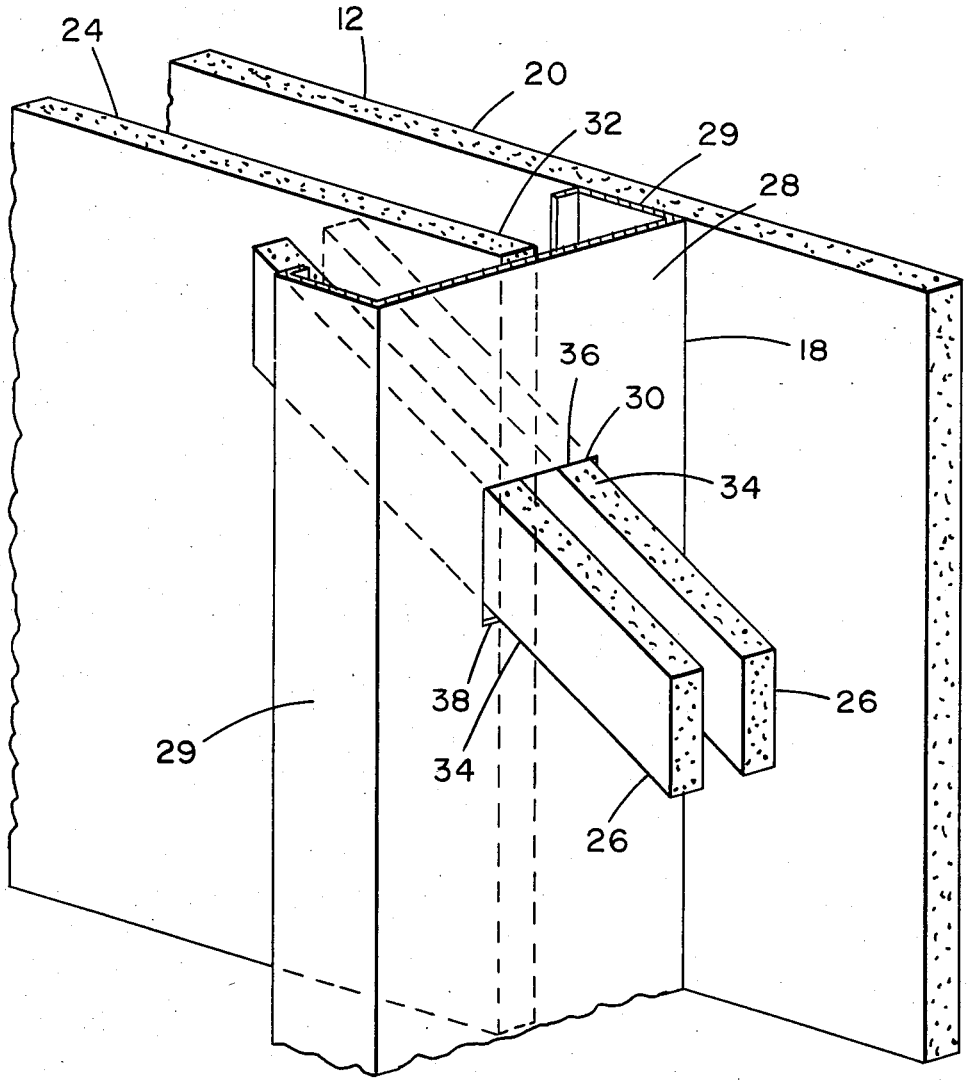
FIG. 3 is an isometric view of the stabilizing strips in place in a stud, stabilizing an edge of a septum panel.

Referring to FIG. 1, there is shown an outside wall 10 of a room in which room there is partially constructed, in accordance with the invention, a hollow partition 12. Partition 12 includes a floor channel 14, ceiling channel 16, vertical metal studs 18, remote side gypsum wallboards 20, near side gypsum wallboards 22, ½ inch thick septum panels 24 centered in the hollow wall midway between wallboards 20 and wallboards 22, and small wallboard scrap strips 26 holding the septum panels in their centered position in the partition 12.

The vertical metal studs 18 are standard light gauge, about 20 or 25 gauge, sheet metal formed in a C-shaped cross-section, including an elongate central web 28 and side flanges 29, 29. The studs are mounted at bottom and top respectively in floor channel 14 and ceiling channel 16. The wallboards 20 and 22 are screw attached to the respective outer faces of the side flanges 29, 29, of studs 18.

The central web 28 of each stud 18 has a plurality of approximately square openings 30 centered in the web at spaced positions therealong, intended for reinforcing channels and plumbing and wiring. At least two of these openings 30 in each stud 18 are used, in the present invention, to stabilize the septum panels 24 which are located between each pair of adjacent studs. These openings 30 are 1½ inches in width and about 1¾ inches in length. Two small scrap strips 26, 26 are disposed in each of at least two openings 30 in each stud 18, to stabilize the two edges 32, 32 of the two ½ inch thick septum panels 24, 24 on each side of each stud 18, with one strip 26 on each side of the centered septum panels 24, 24.

The strips 26 are each about 1½ inches wide, about eight inches long and ½ inch thick. Each strip 26 is disposed with about half of its length on each side of web 28 and extending at an angle to horizontal such that the two side edges 34, 34 of each strip 26 contact respectively the top edge 36 and the bottom edge 38 of the openings 30. By reason of this top and bottom contact, each strip 26 is held permanently in place.

The strips 26 can be made from the scrap from wallboards or septum panels that is normally produced during wall construction work, and thus can be said to be of no cost.

It will be understood that if septum panels thicker than ½ inch are to be used, respectively thinner strips 26 will need to be used with them.

Having completed a detailed disclosure of the preferred embodiment of our invention so that those skilled in the art may practice the same, we contemplate that variations may be made without departing from the essence of the invention or the scope of the appended claims.

We claim:

1. A hollow wall comprising a plurality of spaced, parallel vertical sheet metal studs, wallboards affixed onto each side of said plurality of studs, septum panels disposed within each hollow formed by opposed wallboards and each pair of adjacent studs, and a pair of small strips of board extending through an approximately square opening in the sheet metal web of each of said studs, said opening having a width substantially equal to the thickness of the total of one of said septum panels and said pair of strips of boards, said small strips of board in each stud opening being disposed one on each side of said adjacent septum panels and providing stabilization for said septum panels, said septum panels and said strips of board all being boards of about ½ inch thickness having a gypsum core, said wallboards being gypsum wallboard of about ½ inch thickness and said opening in said stud being about 1½ inches wide.

2. A hollow wall comprising a plurality of spaced, parallel vertical sheet metal studs, wallboards affixed onto each side of said plurality of studs, septum panels disposed within each hollow formed by opposed wallboards and each pair of adjacent studs, and a pair of small strips of board extending through an approximately square opening in the sheet metal web of each of said studs, said opening having a width substantially equal to the thickness of the total of one of said septum panels and said pair of strips of boards, said small strips of board in each stud opening being disposed one on each side of said adjacent septum panels and providing stabilization for said septum panels wherein said strips of board are narrower than the height of said stud openings, and are disposed at an angle to the horizontal with the top and bottom edges of said board strips in contact with said opening top and bottom.

3. A hollow wall as defined in claim 2 wherein said stud openings are about 1¾ inches high and said board strips are about 1½ inches wide.

* * * * *